United States Patent [19]

Kishida

[11] 4,304,956

[45] Dec. 8, 1981

[54] HIGH VOLTAGE SEISMIC BUSHING

[75] Inventor: Mitsuhiro Kishida, Amagasaki, Japan

[73] Assignee: Mitsubishi Denki Kabushiki Kaisha, Tokyo, Japan

[21] Appl. No.: 119,687

[22] Filed: Feb. 8, 1980

[30] Foreign Application Priority Data

Feb. 16, 1979 [JP] Japan ..... 54-17708

[51] Int. Cl.[3] ..... H01B 17/26

[52] U.S. Cl. ..... 174/31 R; 174/152 R; 174/161 R

[58] Field of Search ..... 174/11 BH, 12 BH, 14 BH, 174/15 BH, 16 BH, 18, 31 R, 42, 75 F, 142, 143, 152 R, 161 R, 167; 52/167

[56] References Cited

U.S. PATENT DOCUMENTS 3,856,242 12/1974 Cook ..... 52/167 X

FOREIGN PATENT DOCUMENTS

C 9474 3/1956 Fed. Rep. of Germany ... 174/161 R 501285 2/1939 United Kingdom ..... 174/12 BH

OTHER PUBLICATIONS

Fukazawa; H. et al., "500 Kv Bushings", *Melco Technical Report,* vol. 45, No. 9, 1971, pp. 1094–1104.

*Primary Examiner*—Laramie E. Askin

*Attorney, Agent, or Firm*—E. L. Pencoske

[57] ABSTRACT

A high voltage seismic bushing charged with an insulating material has a procelain tube having an adapter rigidly connected to one end of the tube. The adapter is flexibly connected to a mounting flange such that the porcelain tube is free to move relative to the mounting flange in the event of an earthquake. The means for flexibly connecting the adapter to the mounting flange utilizes a spring mechanism to absorb the energy through friction to attenuate the movement of the porcelain tube. A resilient buffer member is interposed between the adapter and the mounting flange to provide a predetermined spacing therebetween and absorb the impact due to the movement of the adapter relative to the mounting flange. A sealing member seals the interface between the adapter and the mounting flange for containing the insulating material charged therein.

6 Claims, 4 Drawing Figures

HIGH VOLTAGE SEISMIC BUSHING

BACKGROUND OF THE INVENTION

1. Field of the Invention

This invention relates to an electrical bushing used with the lead-wire portion of tank shaped electrical apparatus, wherein the tank has accommodations for a super-high voltage transfer and switching device of the 500 kv and higher classification and wherein the tank is charged with an insulating material such as an insulating gas, oil or the like.

2. Description of the Prior Art

High voltage electrical apparatus may be used in an environment where damage due to airborne pollutants, such as salt, is high. These apparatus utilize bushings with long porcelain tubes, thus making the surface leakage distance long, for connection to associated overhead lines. The bushings must be capable of withstanding such harsh environments. In the case where electrical apparatus are employed in a district having a high frequency of occurrence of earthquakes, such as in Japan, they are always exposed to dangers due to earthquakes and therefore are designed with emphasis on seismic strength. When the electrical apparatus experiences an earthquake, the amplification of the earthquake experienced by the bushings is dependent upon the installation position, the foundation of the equipment, the tank portions, the seat for mounting the bushings, etc. Also, the number of proper vibration, or resonant frequency, is determined by the relationship between the weight distribution and the rigidity of the bushing. If the frequency of an earthquake approximates or corresponds to the resonant frequency of the apparatus, then a resonant phenomenon is developed such that vibrations are amplified on the foundation of the bushing, and on portions of the tank and the seat for mounting the bushing. This resonant phenomenon results in very high vibrations which are applied thereto until the breaking strength of the bushing is exceeded resulting in the breaking of the porcelain tube.

The frequency of earthquakes ranges generally from one to ten hertz. Bushings disposed on electrical apparatus of the 200 kv and higher classification may have a resonant frequency equal to or less than ten hertz which corresponds to the frequency of earthquakes. For its dimensions up to the order of five meters, the porcelain tubes for bushings of these classifications of apparatus have a sufficient seismic strength such that their breaking strength is not exceeded by the greatest earthquakes experienced in the past. However, for the 500 kv and higher classification the use of long porcelain tubes that are of the environmentally resistive type results in a resonant frequency not higher than a few hertz which corresponds to the frequency of earthquakes with a high probability. Thus it is possible for the porcelain tube to break upon the occurrence of great earthquakes. It is difficult to increase the seismic strength of the porcelain tubes. When the 1000 kv class is put to practical use, there is considered as a plan of increasing the seismic strength a method of reinforcing the bushing in three or four directions from its extremity by means of stay insulators or the like. In this case, the vibration of the stay insulators becomes a chordal vibration and a phenomenon is developed which includes an overlapped vibration different from that of the bushing portion. This makes an analysis of the seismic strength difficult and leaves questions about the reliability. Also, it is necessary to consider the flashover voltage with the parallel connection of stay insulators as portions of the bushing apparatus. The adhesion of soils is different between the bushing portion and the stay portion, the stay portion having a smaller diameter is generally apt to be soiled. In any case, it is required to determine the magnitude of the flashover voltage in the parallel state. With these aspects in view, the reliability is also reduced.

SUMMARY OF THE INVENTION

The present invention provides a bushing provided with a spring mechanism for connecting a porcelain tube to a mounting flange and for absorbing energy through friction upon its compression. When the bushing encounters a large earthquake that causes large vibrations to be applied to the bushing mounting portion, the breaking of the porcelain tube can be prevented by the absorption of the energy by the spring mechanism.

DESCRIPTION OF THE PREFERRED EMBODIMENT

Figure 1:
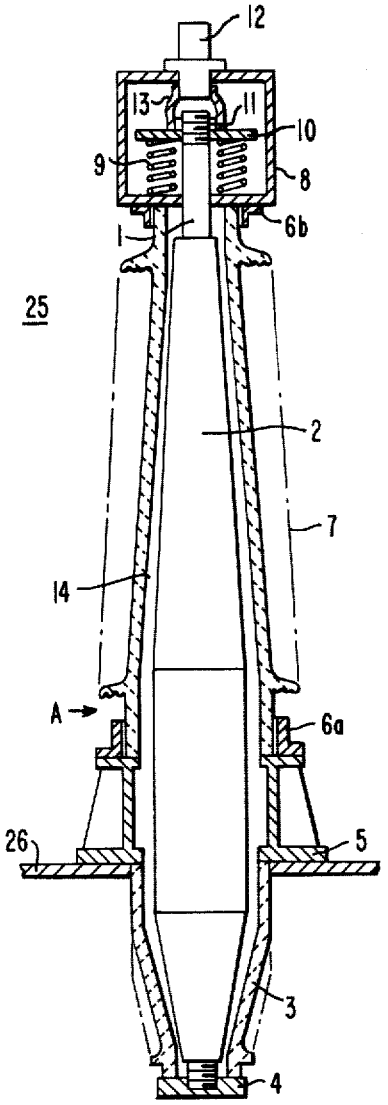
FIG. 1 PRIOR ART
FIG. 1 is a sectional view illustrating a conventional bushing.

In the case of a design according to the conventional concept of environmentally resistive bushings 25 of the 500 kv or higher classification, as shown in FIG. 1, insulating paper is circularly wrapped around a periphery of a central electrode 1. A capacitor unit 2 is provided having field adjustment electrodes inserted therein in the form of concentric cylinders so as to render an internal electric field and an external electric field uniform. A supporting fitting 4 is screw threaded onto and fixed to the central electrode 1 at the lowermost end and supports a lower porcelain tube 3. The member 4 is also used as a terminal fitting. Disposed on the fitting 4 is the lower porcelain tube 3. A gasket (not shown) and a mounting flange 5 are located at the upper end of the lower porcelain tube 3 for disposing and fixing the bushing 25 in sealed relation through an opening disposed in the main body or casing 26 of an electrical apparatus. An upper porcelain tube 7 has attached thereto porcelain tube fittings **6*a* and 6*b* fixed to the lower and upper portions thereof, respectively, by a cement. The lower fitting 6*a* is placed, along with a gasket (not shown), on and fixed to the flange 5 by bolts and nuts (not shown). To the upper fitting 6*b* a head fitting 8 is laid and similarly fixed. The interior of the head fitting 8 accommodates a coiled spring 9 for imparting a compressive force to the porcelain tubes 3 and 7 and the mounting flange 5. A spring keeper plate 10 for compressing the coiled spring 9 and a ring nut 11 fix the compressive force of the spring 9. Further, in a structure having a flexible lead 13 arranged to connect a terminal fitting 12 to the central conductor 1, an insulating oil 14 is charged in the interior. A space is provided within the head fitting 8 which has a suitable volume to prevent an abnormal change in pressure even though the insulating oil 14** may change in volume. An inert gas such as nitrogen is sealed into the space under a suitable pressure. Where the bushing provided on an electrical apparatus encounters an earthquake, vibrations are amplified between the ground and the insulator of the bushing, but the extent of amplification becomes small provided that the rigidity of each portion is high. This results in an increase in seismic strength exhibited by the apparatus. Accordingly, the rigidity of the mounting flange for bushings is generally designed to be as high as possible.

When a bushing of this type is provided on an electrical apparatus, the apparatus as a whole has been designed by paying regard to the seismic strength. The bushing's response to vibrations upon the occurrence of an earthquake may be amplified two-fold or more with respect to the acceleration of the flange mounting portion. Further, it is considered that the amplification is ten odd times at the extremity of the bushing which must withstand the amplified vibrations. However, when vibrated, each portion of the bushing has a mechanical stress applied thereto. The magnitude of the mechanical stress is different from one portion to another portion. A maximum internal bending stress is experienced on the upper surface portion of the lower fitting 6*a* and the lower portion of the upper porcelain tube 7 in FIG. 1, as illustrated by the arrow A. Porcelain tubes have a rupture or bending stress on the order of from 200 to 250 kilograms per centimeter squared and may be broken in excess of this stress.

For bushings including a porcelain tube not so large in dimension, the resonant frequency is high and a resonant phenomenon is less predominant. Also, since the porcelain tube has a large trunk diameter with respect to the weight of the bushing, the seismic strength is sufficient. However, long porcelain tubes are employed for the 500 kv or higher classification and for environmentally resistive applications because of the necessity of rendering the surface leakage distance long. For these bushings, the trunk diameter is not so large in spite of the heavy weight. Therefore, the resonant frequency is low and apt to correspond to the frequency of earthquakes resulting in a resonant phenomenon and large vibrations. It is expected that the internal stress of the porcelain tube at the time of the earthquake easily exceeds the breaking stress. Consequently, in environmentally resistive 500 kv class bushings, according to the conventional concept, there is required a counter-measure of providing stay insulators in more than two directions therearound from the extremity for reinforcement. As described above, the stay insulators have raised difficult questions of reliability.

Figure 2:
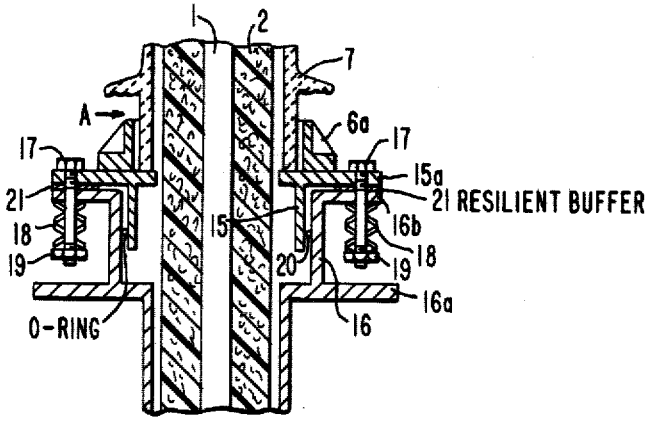
FIG. 2 is a sectional view illustrating the essential portion of one embodiment of the present invention.

Turning now to the present invention, the description is made hereinafter with respect to the FIGS. 2, 3 and 4. In the figures the identical reference numerals designate the identical or corresponding components. In FIG. 2 the central electrode 1, capacitive unit 2, lower tube fitting 6*a*, and the porcelain tube 7 are similar to the prior art. A hollow cylindrical adapter 15 has one end rigidly fixed to the porcelain tube 7 through the fitting 6*a* and has a connecting portion 15*a* extending in a direction perpendicular to the central electrode 1. A hollow cylindrical mounting flange 16 is fitted onto the adapter 15 and has a mounting portion 16*a* extending in a direction perpendicular to the central electrode 1 and a connecting portion 16*b* opposite to the connecting portion 15*a* of the adapter 15. A plurality of bolts 17 extend through the two connecting portions 15*a* and 16*b*. A spring mechanism 18 is held by the bolts 17 and nuts 19 such that the spring mechanism 18 is capable of maintaining a predetermined fastening force. The spring mechanism 18 is formed of a plurality of dish-shaped springs superimposed on one another so as to absorb vibrational energy through friction upon their compression. A sealing member 20 is interposed between the adapter 15 and the mounting flange 16. The sealing member 20 is formed of an O-ring for sealing the interior of the porcelain tube 7 from the exterior thereof and for sealing the interface between the adapter 15 and the mounting flange 16. A resilient buffer member 21 is interposed between the two connecting members 15*a* and 16*a* for maintaining a predetermined spacing therebetween.

In a bushing having such a structure the fastening force of the spring mechanism 18 is set to a magnitude such that the base of the porcelain tube 7, or the portion designated by arrow A, has an internal stress leaving a sufficient margin with respect to the breaking stress upon the application of a bending load to the bushing. Where the bushing resonates creating large vibrations, the spring mechanism 18 is caused to be compressed in the event the amplitude of the bending load reaches the set pressure of the spring mechanism 18. In the event of larger vibrations at a further higher amplitude, the spring mechanism 18 absorbs energy through its friction to attenuate the vibrations. In this way the bushing responds to accelerations. The spring mechanism 18 is initially compressed and the internal stress of the porcelain tube 7 is not high so that the bending load can be suppressed to be less than the breaking stress. As compared with a rigid fixture, the breaking of the porcelain tube 7 can be prevented against even larger earthquakes.

It is considered that when the spring mechanism 18 is moved, a clearance occurs around the buffer member 21 between the two connecting portions 15*a* and 16*b*. However, the sealing member 20 is disposed between the mounting flange 16 and the adapter 15 to prevent the insulating fluid from flowing out through that portion. Also, the inversion of the phase of the vibrations results in the closure of the clearance between the two connecting portions 15*a* and 16*b*. At that moment, a high impact force is applied to the connecting portions 15*a* and 16*b*. The impact force strikes against the surfaces of the resilient buffer member 21 and the impact is absorbed by means of its cushioning properties.

Figure 3:
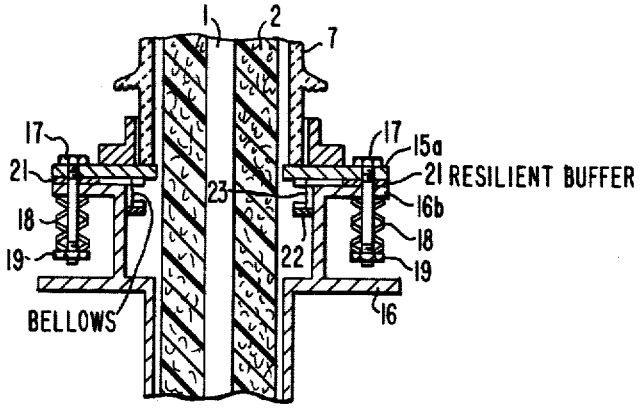
FIGS. 3 and 4 are sectional views illustrating the essential portion of other embodiments of the present invention.

In the embodiment as described above, a bellows fitting 22 may be weld mounted to the mounting flange 16 and a bellows 23 may be mounted between the bellows fitting 22 and the adapter 15 as shown in FIG. 3 whereby a perfect sealing structure can be ensured even when a clearance has been formed between the portions 15*a* and 16*b*.

Figure 4:
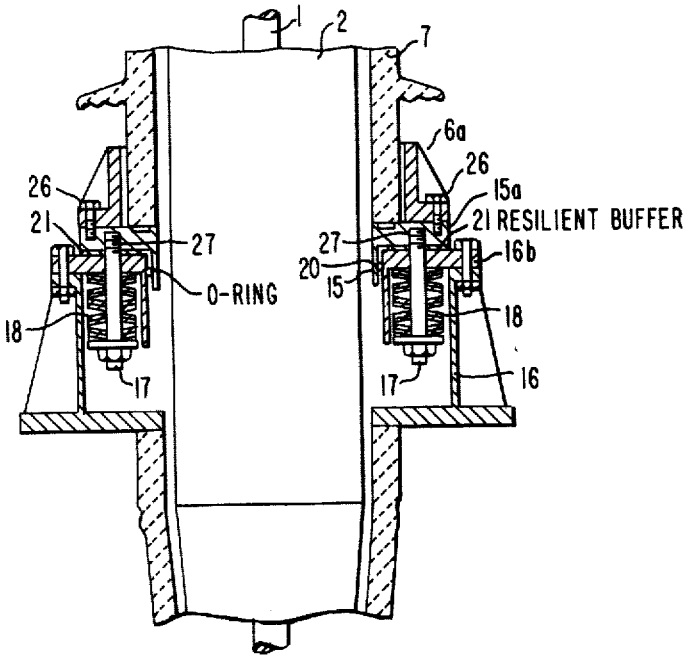

While the spring mechanism 18 is disposed outside the flange 16 in the embodiments as described above, the same effect is expected with the spring mechanism disposed inside the flange 16 as shown in FIG. 4. FIG. 4 also illustrates bolts 26 for securing the lower tube fitting 6*a* to the connecting portion 15*a* of the adapter 15. The connecting portions 15*a* and 16*b* are connected by the bolts 17 screwed into mating threads 27 thus eliminating the need for the nuts 19.

While in the above-mentioned embodiments the description has been made in conjunction with electrical apparatus charged with an insulating oil, the same effect is expected with electrical apparatus charged with an insulating gas.

The present invention can provide an increase in seismic strength by rigidly connecting an adapter to a porcelain tube, and flexibly connecting the adapter to a mounting flange by a spring mechanism. This is because when large vibrations are applied to the mounting portion of a bushing, the vibrational energy can be absorbed by the spring mechanism, thus protecting the porcelain tube from breaking.

Briefly reviewing, a bushing having a structure as described herein is disposed on an electrical apparatus including a tank for a transformer or the like. A vibration is applied to the foundation, the main body of the electrical equipment, the mounting flange 16 for the bushing 25, etc. upon the occurrence of an earthquake. Large vibrations are applied to the bushing 25 so that the vibrational system is varied at, and after, the moment the spring mechanism 18 is operated. This results in a change in the resonant frequency of the bushing. If the amplitude tends to be higher, then energy is absorbed through the friction of the spring mechanism 18 to increase the attenuation to prevent a portion of the porcelain tube 7 from responding to the acceleration. Even for a large earthquake the internal stress of the porcelain tube can be suppressed to the breaking force or less.

What is claimed is:

1. A high voltage seismic bushing charged with an insulating material and having a central conductor extending therethrough, comprising:

a porcelain tube;

an adapter rigidly connected to one end of said tube;

a mounting flange;

means for flexibly connecting said adapter to said mounting flange such that said porcelain tube is free to move relative to said mounting flange, said means for connecting absorbing the energy of said motion;

a resilient buffer member interposed between said adapter and said mounting flange to provide both a predetermined spacing and to cushion collisions therebetween;

and a sealing member for sealing the interface between said adapter and said mounting flange for containing said insulating material.

2. The bushing of claim 1 wherein the sealing member includes an O-ring.

3. The bushing of claim 1 wherein the sealing member includes a bellows.

4. The bushing of claim 1 wherein the means for connecting includes a plurality of bolts each having a spring thereon.

5. The bushing of claim 4 wherein the bolts are disposed outside the mounting flange.

6. The bushing of claim 4 wherein the bolts are disposed inside the mounting flange.

* * * * *